United States Patent [19]

Smith

[11] 4,037,299

[45] July 26, 1977

[54] TEXTILE COT ASSEMBLY

[75] Inventor: Kenneth C. Smith, Westhoughton, near Bolton, England

[73] Assignee: Dayco Corporation, Dayton, Ohio

[21] Appl. No.: 711,921

[22] Filed: Aug. 5, 1976

Related U.S. Application Data

[63] Continuation-in-part of Ser. No. 581,321, May 27, 1975, abandoned.

[51] Int. Cl.[2] ..... B21B 31/08

[52] U.S. Cl. ..... 29/130

[58] Field of Search ..... 29/129.5, 130, 129, 29/116 R

[56] References Cited

U.S. PATENT DOCUMENTS

| | | | |
|---|---|---|---|
| 546,639 | 9/1895 | Campbell | 29/116 R |
| 2,715,879 | 8/1955 | Sawyer | 29/130 X |
| 2,924,184 | 2/1960 | Welch | 29/129.5 X |
| 3,647,589 | 3/1972 | Felden | 29/130 X |
| 3,724,047 | 4/1973 | Peterson | 29/129.5 |
| 3,827,120 | 8/1974 | Mayer | 29/130 X |

FOREIGN PATENT DOCUMENTS

| | | | |
|---|---|---|---|
| 402,684 | 5/1966 | Switzerland | 29/116 R |
| 235,234 | 4/1926 | United Kingdom | 29/130 |
| 504,456 | 4/1939 | United Kingdom | 29/129.5 |

*Primary Examiner*—Alfred R. Guest
*Attorney, Agent, or Firm*—Reuben Wolk

[57] ABSTRACT

A textile cot assembly and sleeve comprising same is provided and such assembly has a rigid cylindrical support and an elastomeric sleeve disposed in a stretched condition concentrically around the support.

6 Claims, 9 Drawing Figures

TEXTILE COT ASSEMBLY

CROSS-REFERENCE TO RELATED APPLICATION

This application is a continuation-in-part of co-pending application Ser. No. 581,321 filed May 27, 1975 now abandoned.

BACKGROUND OF THE INVENTION

The textile industry employs so-called cots or cot assemblies for the purpose of drafting or drawing textile fibers to produce yarn, sliver, roving, and the like; and, many types of cots have been proposed heretofore. However, the basic element which is employed on a cot is an outer sleeve-like working member which is often made of an elastomeric material.

During operation this sleeve-like working member becomes excessively worn requiring either replacement thereof or of the entire cot. However, a serious problem with cots proposed heretofore is that the replacement of either the entire cot or of its working member has resulted in excessive costs.

SUMMARY

It is a feature of this invention to provide a textile cot assembly, and a sleeve for use therewith, wherein such assembly is of optimum simplicity and is easily kept in efficient working condition at minimum cost.

Another feature of this invention is to provide a textile cot assembly comprising rigid cylindrical supporting means and an elastic sleeve made of an elastomeric material and having a tubular inside surface and a plurality of gripping projections extending radially inwardly from the inside surface with each projection having an inner portion engaging the cylindrical supporting means. The sleeve is disposed in stretched condition with its diameter increased within the range of approximately 3 to 8 percent from its unstretched condition with the inner portions of the projections being partially deformed at their areas of contact with the rigid cylindrical supporting means by radially inward pressure exerted by the stretched sleeve. The projections with their partially deformed inner portions prevent rotation of the sleeve relative to the cylindrical supporting means.

Another feature of this invention is to provide a cot assembly comprising a cylindrical supporting core which has a rigid tubular member fixed concentrically around the core and the member has a right circular cylindrical supporting surface of a particular diameter adjoined at opposite edges thereof by a pair of shoulders. An elastomeric sleeve, which is easily installed by stretching, is disposed in a stretched condition concentrically around the member with its entire inside surface against the right circular cylindrical surface and the sleeve is stretched so that its diameter is increased with an approximate range of 3 to 8 percent from an unstretched condition thereof and with the sleeve being confined against axial movement by the shoulders.

Accordingly, it is an object of this invention to provide an improved textile cot assembly and sleeve for use therewith, or the like, having one or more of the novel features set forth above or hereinafter shown or described.

Other objects, features, details, uses, and advantages of this invention will be readily apparent from the embodiments thereof presented in the following specification, claims, and drawings.

BRIEF DESCRIPTION OF THE DRAWINGS

The accompanying drawings show present preferred embodiments of this invention, in which FIG. 1 is an exploded perspective view illustrating one exemplary embodiment of the cot assembly of this invention which is particularly adapted to be mounted on a roller having anti-friction bearing means, or the like;

DESCRIPTION OF ILLUSTRATED EMBODIMENTS

Figure 1:
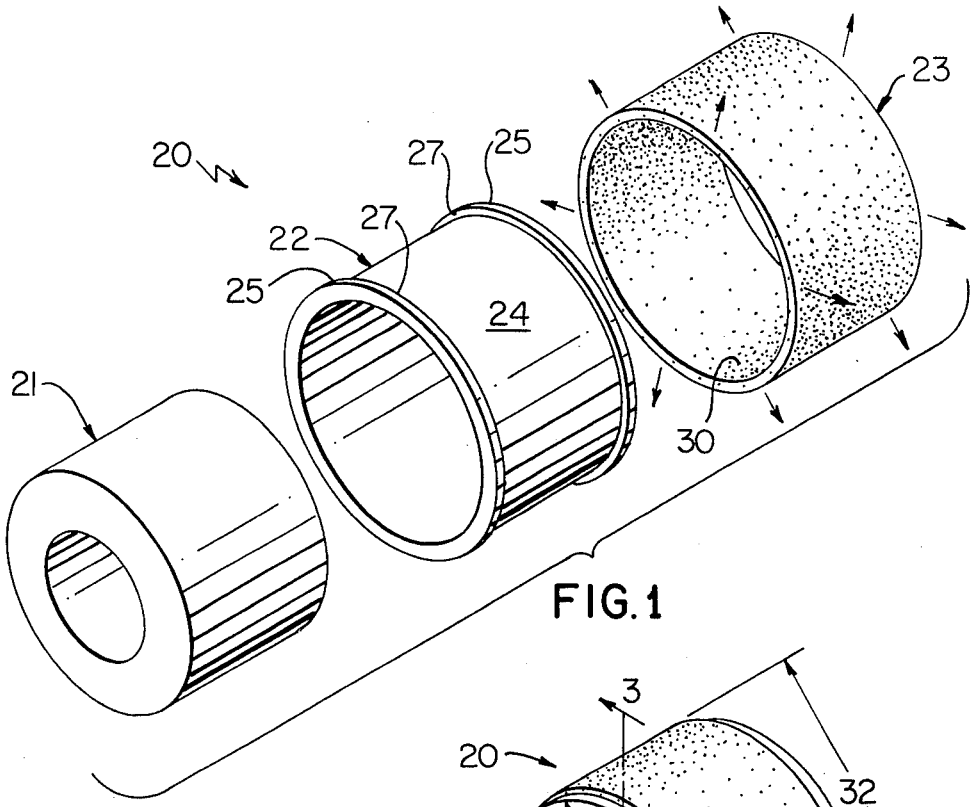

Reference is now made to FIG. 1 of the drawings which illustrate an exemplary embodiment of a textile cot or cot assembly of this invention which is designated generally by the reference numeral 20 and is of the type used in the textile industry for the drafting or drawing of textile fibers or similar fibers to produce slivers, rovings, yarns, etc.

The assembly 20 comprises a cylindrical supporting core 21 (which in this example is tubular) a rigid tubular cylindrical supporting means or member 22, and an elastomeric sleeve 23 constructed and arranged in the detailed manner now to be described. The supporting core 21 may be installed on a roller or other suitable structure to enable rotation thereof and hence rotation of tubular member 22 and elastomeric sleeve 23 in accordance with techniques which are well known in the textile art.

The cylindrical supporting core 21 may be made of any suitable rigid material such as a metallic material for example; and, the rigid tubular member 22 is made of any material enabling it to be fixed concentrically around the core. The member 22 is preferably press fit concentrically around the core 21.

The member 22 may be made of any suitable material; however, such member is preferably made of a rigid hard plastic material. As best seen in FIG. 1 the member 22 has a right circular cylindrical supporting surface 24 of a particular diameter adjoined at opposite edges thereof by a pair of shoulders each designated by the same reference numeral 25. The shoulders 25 are shown as annular shoulders which have the same diameter indicated at 26 which is greater than the diameter of the right circular cylindrical surface 24 and each of the annular shoulders 25 has a planar annular surface 27 which is arranged substantially perpendicular to the right circular cylindrical surface 24 for a purpose to be described in detail subsequently.

Figure 2:
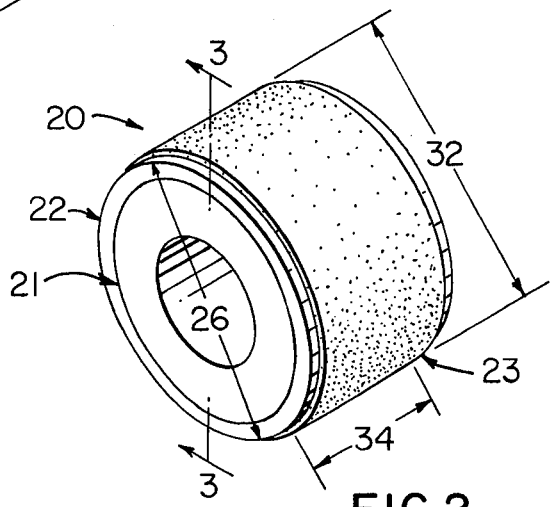
FIG. 2 is a perspective view particularly illustrating the cot assembly of FIG. 1 in an assembled condition and illustrating an elastomeric sleeve disposed in a stretched condition concentrically around an outer rigid tubular member of the cot assembly.

The elastomeric sleeve 23 is shown in a radially expanded or stretched condition by radially arranged arrows in FIG. 1 to highlight the manner in which it is easily slipped over the annular shoulders 25 and the right circular cylindrical surface 24 of member 22. The elastomeric sleeve is particularly adapted to be disposed and in the completed cot assembly 20 of FIG. 2 is disposed in a stretched condition concentrically around the member 22 with its entire inside surface 30 against the right circular cylindrical surface 24. The sleeve 23 is supported in an expanded or stretched condition so that its diameter is increased within the range of approximately 3 to 8 percent from an unstretched condition thereof and the sleeve is confined against axial movement thereof by the shoulders 25 and in particular by the annular surfaces 27 of the shoulders 25. It will also be appreciated that to dispose or place the sleeve 23 in position on the surface 24, it may be momentarily stretched more than 8 percent to enable movement thereof over an annular shoulder 25.

Figure 3:
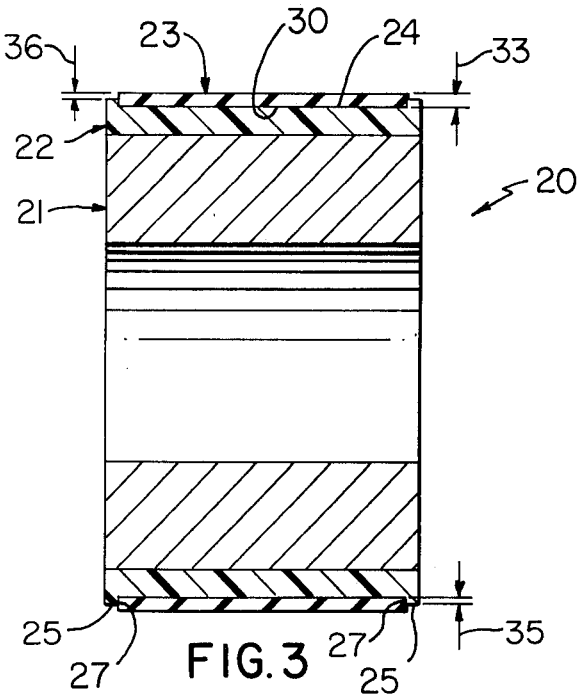
FIG. 3 is a cross-sectional view taken essentially on the line 3—3 of FIG. 2.

The sleeve 23 may be made of a rubber material and such rubber material may be any type of natural rubber or synthethic rubber compound, see FIG. 3. The hardness of the sleeve 23 is generally controlled within a range from 40 to 90 as measured on the Shore Durometer utilizing the A scale; preferably the Shore A hardness is approximately 80.

Figure 4:
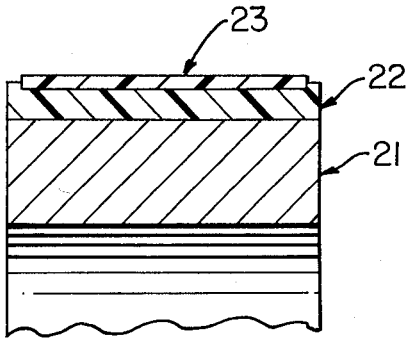
FIG. 4 is a fragmentary cross-sectional view similar to the upper portion of FIG. 3 and illustrating an elastomeric sleeve comprising the outer portion of the cot assembly made of a plastic material instead of rubber as shown in FIG. 3.

The sleeve 23 may also be made of a suitable stretchable synthetic plastic material as shown in FIG. 4. In those applications where the sleeve 23 is made of plastic it is also constructed so that it is capable of being stretched so that its diameter is increased between the approximate range of 3 to 8 percent from an unstretched condition thereof; and, the hardness of such a plastic sleeve is comparable to the hardness of a rubber sleeve as described earlier.

The cot assembly of this invention may be of any suitable size; however, the following is an example of an assembly which has been used successfully. In such assembly the finished outside diameter of the stretched sleeve, such as the diameter 32 shown in FIG. 2, may vary between 2 ¼ and 2 ⅜ inches with the sleeve thickness, indicated at 33, ranging between 0.055 and 0.075 inch while maintaining the finished outside diameter. A sleeve of such a finished outside diameter should have a height (as indicated at 34) of roughly 1 7/16 inch. The outside diameter of the cylindrical supporting core 21 and the inside and outside diameters of the rigid tubular member 22 are suitably correlated to maintain the desired finished diameter; and the height of the member 22 between flanges 25 is suitably controlled to receive the sleeve 23 therebetween. In general, because of material costs, it is preferred to utilize a sleeve of minimum thickness (closer to 0.055 inch) and once the working surface of the sleeve 23 becomes worn it is merely stretched and pulled over a shoulder 25 or cut and torn off, then discarded. The stretching of a sleeve 23 for installation and removal purposes and regardless of the sleeve size is preferably achieved by hand.

To assure proper operation of the cot assembly 20, the outside diameter 32 of the sleeve in its stretched condition on surface 24 is such that it is greater than the diameter 26 thereby providing a thickness 36 of the sleeve 23 which extends outwardly of the annular shoulders 25 thereby assuring that such shoulders do not interfere with the operation of the sleeve 23. The height of each shoulder 25 above the right circular cylindrical surface 24 as indicated at 35 is generally of the order of 0.028 inch with the width of such shoulder being generally of the order of 0.040 inch.

The tubular member 22 has been illustrated and described as being made of a plastic material and polypropylene has been used successfully. However, it is to be understood that any suitable plastic material or natural rubber or snythetic rubber compound may be employed as well as any suitable metallic material which is substantially rigid.

The annular shoulders 25 are shown provided on the plastic member as an integral part of the single piece part 22. However, such shoulders may be provided as separate parts and suitably fixed at opposite ends of the part 22. Similar separate shoulders 25 may also be suitably fixed on a metal member 22.

The teaching of this invention may be utilized in connection with cot assemblies presently in existence which have outer working surfaces fixed on a rigid roller, or the like. For example, such outer working surfaces may be suitably cut away and their support also suitably cut away and reduced in diameter by using a lathe, or the like. A rigid tubular member 22 may then be fixed in position on the reduced diameter support and a sleeve 23 suitably stretched in position on the member 22.

Other exemplary embodiments of the textile cot assembly of this invention are illustrated in FIGS. 5–6, 7, 8, and 9. The cot assembly illustrated in each of these FIGS. is very similar to the cot assembly 20; therefore, the cot assembly of FIGS. 5–6, 7, 8, 9 will be designated by the reference numerals 20A, 20B, 20C, and 20D respectively and parts of the cot assembly 20A, 20B, 20C, and 20D which are similar to corresponding parts of the cot assembly 20 will be designated by the same reference numeral as in the cot assembly 20 followed by the associated letter designation either A, B, C, or D and not described in detail. Only those component parts of each cot assembly that are different from corresponding parts of the cot assembly 20 will be designated by new reference numerals also followed by the associated letter designation and described in detail.

Figure 5:
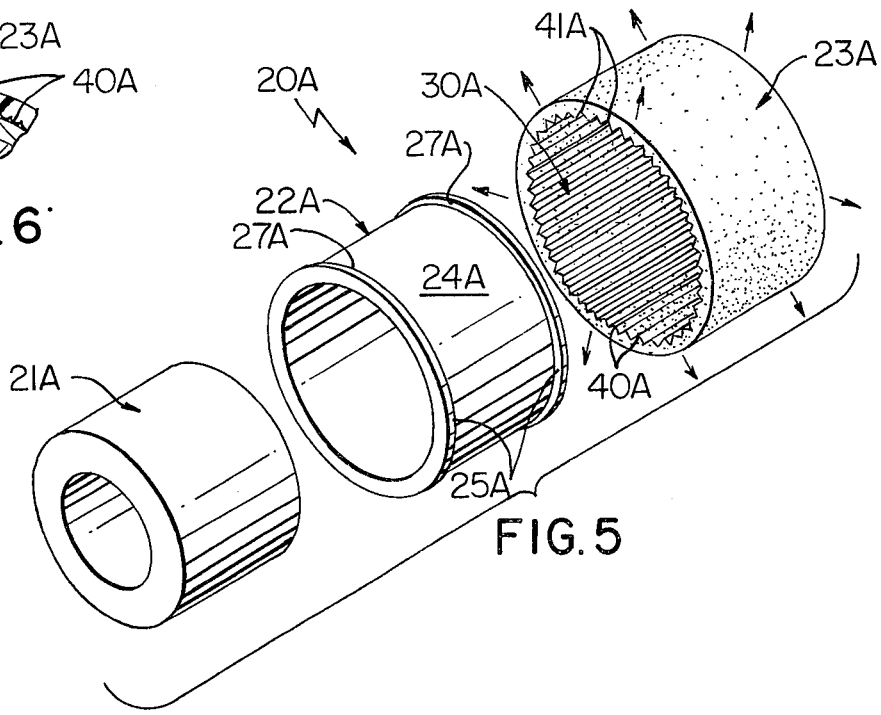
FIG. 5 is a view similar to FIG. 1 illustrating another exemplary embodiment of the cot assembly of this invention which has an elastic sleeve made of an elastomeric material and such sleeve has a plurality of gripping projections extending from a cylindrical inside surface thereof.

The cot assembly 20A of FIG. 5 comprises a cylindrical supporting core 21A and a rigid tubular cylindrical supporting means or member 22A which has a right circular cylindrical supporting surface 24A adjoined by a pair of annular shoulders 25A at opposite edges thereof and each shoulder 25A has a planar annular inside surface 27A adjoining an associated edge of surface 24A. The assembly 20A also has an elastic sleeve 23A similar to sleeve 23 and made of an elastomeric material and the sleeve 23A has an inside surface 30A which is provided with a plurality of gripping projections 40A extending radially inwardly from its inside surface; and, in this example the inside surface 30A is defined by a plurality of alternating substantially V-shaped projections 40A and channels 41A which extend the entire axial length of the sleeve 23A and about its entire inside circumference in a continuous roughly saw-toothed manner.

Figure 6:
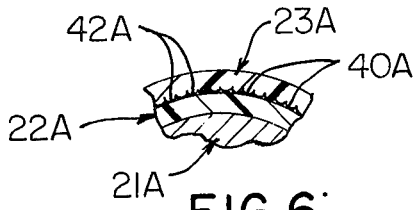
FIG. 6 is a fragmentary cross-sectional view particularly illustrating the cot assembly of FIG. 5 in assembled condition and illustrating the gripping projections of the sleeve partially deformed against a tubular cylindrical member thereof.

Each projection 40A is, in essence, a gripping projection and, as shown in FIG. 6, has a deformed or partially flattened inner portion 42A engaging the right circular cylindrical supporting surface 24A of the sleeve 22A. The sleeve 23A is disposed in stretched condition around the tubular member 22A with the diameter of the sleeve 23A increased within the range of approximately 3 to 8 percent from its unstretched condition and each deformed inner portion 42A is in its deformed configuration or condition by radially inward pressure exerted by the stretched sleeve 23A. The deformed inner portions 42A prevent rotation of the sleeve relative to the right circular cylindrical surface 24A of member 22A and the core 21A fixed thereto.

Figure 7:
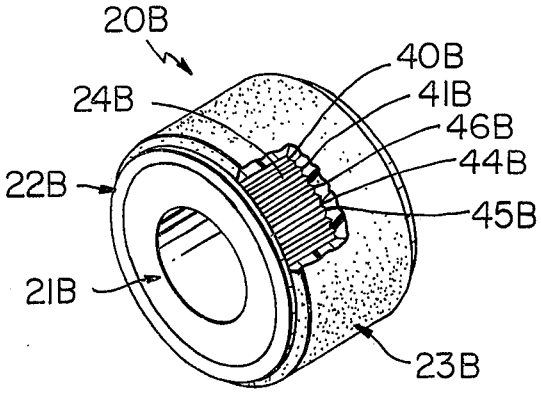
FIG. 7 is a perspective view of another exemplary embodiment of the cot assembly of this invention showing a part of its sleeve broken away.

The cot assembly 20B of FIG. 7 is very similar to the cot assembly 20A with the exception that the tubular member fixed around the core member 21B also has supporting means or a supporting surface 24B defined by a plurality of alternating V-shaped channels 44B and projections 45B provided in lieu of a right circular cylindrical supporting surface such as surface 24A of the member 22A. The construction and arrangement of the channels 44B and projections 45B is such that they precisely receive projections 40B and channels 41B of the sleeve 23B in its stretched condition therearound so that the sleeve 23B is, in essence, in splined radially inwardly exerted pressure contact with the member 22B. This radially inwardly exerted pressure contact is provided about the entire periphery of the member 22B by the cooperating component portions 40B-41B and 44B-45B which give the outside surface of sleeve 23B a more precisely controlled resiliency due to controlled stretch being provided by a plurality of parallel narrow width axial bands defined by the bottom edges 46B of channels 41B about the entire sleeve 23B. The splined arrangement of sleeve 23B on member 22B eliminates any tendency for relative rotation between sleeve 23B and member 22B and this is achieved free of additional components, such as adhesives, or the like.

Figure 8:
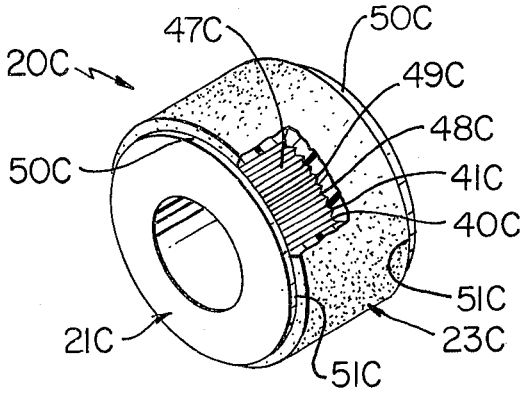
FIG. 8 is a view similar to FIG. 7 illustrating another exemplary embodiment of the cot assembly of this invention.

The cot assembly 20C of FIG. 8 is similar to the cot assembly 20B; however, assembly 20C eliminates the intermediate tubular member such as member 22 of the cot assembly 20. Thus, it will be seen that only a core member 21C is provided and has a sleeve supporting means or surface 47C defined by a plurality of alternating V-shaped channels 48C and projections 49C.

The member 21C also has opposed shoulders 50C each having a planar annular surface 51C; and, the sleeve 23C is disposed in stretched condition about its supporting means or surface 47C with its diameter increased within the range of approximately 3 to 8 percent from its unstretched condition as in the case of previously described sleeves. The sleeve 23C also has alternating projections 40C and channels 41C, and these projections 40C and channels 41C are received within cooperating channels 48C and projections 49C of the core member 21C.

The channels 48C and projections 49C of assembly 20C and the channels 44B and projections 45B of assembly 20B are in each instance constructed and arranged so as to be sized at a greater pitch or spacing between projections, for example, than the pitch or spacing of the projections of the associated sleeve in its unstretched condition. However, once the associated sleeve is in its stretched condition of 3 to 8 percent from its unstretched condition the projections and channels of the sleeve are received in their associated grooves and projections in a splined manner as described earlier.

Figure 9:
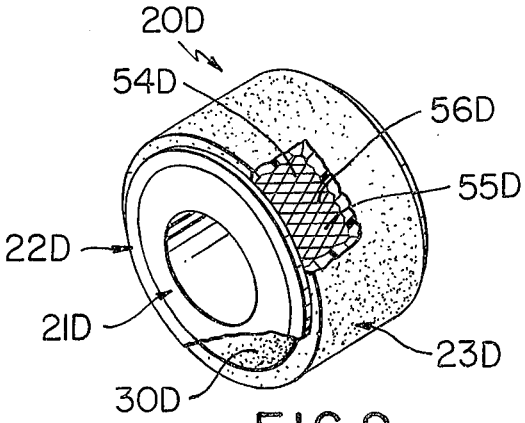
FIG. 9 is a view similar to FIG. 7 and illustrating another exemplary embodiment of the cot assembly of this invention.

The cot assembly 20D of FIG. 9 is comprised of a plain elastic sleeve 23D made of an elastomeric material similar to the sleeve 23 of assembly 20 and is disposed in stretched condition within the range previously described on a supporting surface 54D which is in the form of a knurled surface having a plurality of projections 55D and recesses 56D. The knurled supporting surface 54D prevents rotation of the stretched sleeve 23D relative to surface 54D.

The surface 54D is provided on member 22D which is fixed to member 21D. However, it is to be understood that the knurled surface 54D may be provided as an integral part of a core member similar to the core member 21D, if desired. The sleeve 23D has a smooth surface 30D supported on surface 54D.

It will also be appreciated that instead of providing a supporting surface defined by alternating channels and projections on a core member which receives projections and channels respectively of a sleeve therearound such core member may have a plain right circular cylindrical supporting surface adjoined by annular flanges at opposite side edges thereof whereby such a plain surface on a core member may receive a stretched sleeve thereagainst in a similar manner as described in connection with the sleeve 23A stretched against plain surface 24A.

In this disclosure of the invention each of the supporting cores such as core 21, for example, has been shown as a simple tubular cylindrical supporting core, and this has been achieved for simplicity of drawing and description. However, it will be appreciated that each supporting core may be provided with suitable bearings and other supporting means, as required to enable operation of its cot assembly in a manner which is well known in the art.

While present exemplary embodiments of this invention, and methods of practicing the same, have been illustrated and described, it will be recognized that this invention may be otherwise variously embodied and practiced within the scope of the following claims.

What is claimed is:

1. A textile cot assembly comprising a rigid cylindrical core; a rigid tubular cylindrical supporting means fixed concentrically around said core and having a supporting surface adjoined at opposite edges thereof by a pair of annular shoulders of greater diameter than said surface; and an elastomeric sleeve having a tubular inside surface and a plurality of gripping projections extending radially inwardly from said inside surface with each projection having an inner portion engaging said supporting means, said sleeve being disposed in stretched condition with its diameter increased within the range of approximately 3 to 8 percent from its unstretched condition, the outer diameter of said sleeve, when stretched and seated, being greater than the outside diameter of said shoulders, said inner portions of said projections being partially deformed at their area of contact with said supporting means by radially inward pressure exerted by said stretched sleeve, said projections with their partially deformed inner portions preventing rotation of said sleeve relative to said supporting means.

2. An assembly as set forth in claim 1 in which each of said projections has a substantially V-shaped cross-sectional configuration.

3. An assembly as set forth in claim 1 in which said sleeve has a plurality of integral channels defined therein in an alternating manner with said projections, said rigid supporting means having a plurality of integral channels and projections which receive said projections and channels respectively of said sleeve therewithin.

4. An assembly as set forth in claim 3 in which said projections on said supporting means have a spacing which is greater than the spacing of the projections of said sleeve in its unstretched condition.

5. A textile cot assembly comprising a rigid cylindrical core, a rigid tubular cylindrical supporting means fixed concentrically around said core and having a supporting surface adjoined at opposite edges thereof by a pair of annular shoulders of greater diameter than said surface; an elastomeric sleeve having a tubular inside surface; and a plurality of gripping projections extending from one of said surfaces with each projection having a terminal portion engaging the other of said surfaces; said sleeve being disposed in stretched condition with its diameter increased within the range of approximately 3 to 8 percent from its unstretched condition, the outer diameter of said sleeve, when stretched and seated, being greater than the outside diameter of said shoulders, said terminal portions of said projections preventing rotation of said sleeve relative to its cylindrical supporting means.

6. An assembly as set forth in claim 5 in which said plurality of gripping projections comprise part of a knurled surface of said supporting means and said inside surface of said sleeve is a plain cylindrical surface engaging said knurled surface.

* * * * *